US008431843B2

(12) United States Patent
Chen

(10) Patent No.: US 8,431,843 B2
(45) Date of Patent: Apr. 30, 2013

(54) LUMINOUS KEYBOARD

(75) Inventor: Bo-An Chen, Taipei (TW)

(73) Assignee: Primax Electronics Ltd., Taipei (TW)

( * ) Notice: Subject to any disclaimer, the term of this patent is extended or adjusted under 35 U.S.C. 154(b) by 276 days.

(21) Appl. No.: 13/015,438

(22) Filed: Jan. 27, 2011

(65) Prior Publication Data

US 2012/0152715 A1 Jun. 21, 2012

(30) Foreign Application Priority Data

Dec. 20, 2010 (TW) ..... 99144712 A

(51) Int. Cl.
*H01H 9/26* (2006.01)

(52) U.S. Cl.
USPC ..... 200/5 A

(58) Field of Classification Search ..... 200/310–314, 200/5 A, 512, 517, 344–345; 362/555, 558, 362/559, 616, 26, 27
See application file for complete search history.

(56) References Cited

U.S. PATENT DOCUMENTS 5,975,711 A * 11/1999 Parker et al. ..... 362/24
7,588,338 B2 * 9/2009 Chou ..... 362/24
8,071,900 B2 * 12/2011 Hsu et al. ..... 200/314

* cited by examiner

*Primary Examiner* — Edwin A. Leon
(74) *Attorney, Agent, or Firm* — Tracy M. Heims; Apex Juris, PLLC

(57) ABSTRACT

The present invention discloses a luminous keyboard. The luminous keyboard includes an illumination element, a membrane circuit board, and a plurality of keys. The membrane circuit board includes an upper board and a lower board with a plurality of light guide points. The lower board and the upper board have a first circuit layout and a second circuit layout respectively to form a plurality of membrane switches. The plurality of light guide points of the lower board are used to aggregate and scatter light beams provided by the illumination element. Besides, the lower board includes a first membrane and a second membrane in order to increase the upward-scattering light quality of the plurality of light guide points.

30 Claims, 8 Drawing Sheets

LUMINOUS KEYBOARD

CROSS-REFERENCES TO RELATED APPLICATIONS

This non-provisional application claims priority under 35 U.S.C. §119(a) to Patent Application No(s). 099144712 filed in Taiwan, R.O.C. on Dec. 20, 2010, the entire contents of which are hereby incorporated by reference.

FIELD OF THE INVENTION

The present invention generally relates to a keyboard, and more particularly to a luminous keyboard.

BACKGROUND OF THE INVENTION

In recent years, many users may use portable information devices, for example a notebook personal computer (PC), a cell phone or a personal digital assistant (PDA), in various environments due to the rapid development of information industries. However, numbers and letters on keyboards or keys of the portable information devices may not be clear in a darker environment, and thus the portable information devices are difficult to be operated, or even may damage the vision due to discerning the numbers and letters hardly. Therefore, the development of luminous keyboards may reduce the inconvenience of using the keyboards in a darker environment. Further, the information devices with a luminous keyboard may be more artistic by disposing various illumination elements and thus may be more popular.

FIG. 1 illustrates a structural cross-sectional view of a conventional luminous keyboard. Referring to FIG. 1, the luminous keyboard 1 comprises a reflector 11, a light guide plate 12, a metal base plate 13, a membrane circuit board 14, a plurality of keys and an illumination element 16. Herein the membrane circuit board 14 comprises a lower board 141, an upper board 142 and a middle board 143 disposed between the lower board 141 and the upper board 142. In addition, each of the lower board 141, the middle board 143 and the upper board 142 may be made of a transparent light guide material, such as polycarbonate (PC) or polyethylene terephthalate (PET).

FIG. 2 illustrates an exploded perspective view of a membrane circuit board of the luminous keyboard as shown in FIG. 1. Further referring to FIGS. 1 and 2 together, the lower board 141 has a first circuit layout 1411 composed of a plurality of silver glue circuits 14111 and a plurality of lower pads 14112. The upper board 142 has a second circuit layout 1421 composed of a plurality of silver glue circuits 14211 and a plurality of upper pads 14212. Furthermore, the middle board 143 has a plurality of pad openings 1431 corresponding to the plurality of lower pads 14122 and the plurality of upper pads 14212. Herein, each of the upper pads 14212 and the corresponding one of the lower pads 14112 form a membrane switch 144 together. Besides, each of the keys 15 has a cap 151 and an elastomer 152, and the elastomer 152 is disposed between the cap 151 and the membrane circuit board 141.

When any one of the keys 15 is pressed to move downwards, the cap 151 presses the elastomer 152 to let the elastomer 152 push the corresponding one of the upper pads 14212. Thus, the corresponding one of the upper pads 14212 contacts the corresponding one of the lower pads 14122 via the corresponding one of the pad openings 1431 to switch on the corresponding one of the membrane switches 144, and thus the luminous keyboard 1 generates a corresponding key signal accordingly. Furthermore, the position of the cap 151 returns upwards due to an elastic force of the elastomer 152 when a user releases the cap 151.

Besides, the illumination element 16 is disposed at a side of the light guide plate 12 for providing light beams emitting into the light guide plate 12. The light guide plate 12 is disposed on the reflector 11 and a lower surface thereof has a plurality of light guide points 121 used to aggregate and scatter the light beams. The plurality of light guide points 121 are disposed corresponding to the positions of the plurality of keys 15. The metal base plate 13 has a plurality of apertures 131 corresponding to the plurality of light guide points 121. Herein, the light beams are able to be diffused all over the light guide plate 12 after the light beams are emitted into the light guide plate 12, and the plurality of light guide points 121 scatter the light beams upwards and downwards due to made of ink material(s). The light beams scattered upwards pass through the plurality of apertures 131 and then are projected to the membrane circuit board 14 and the plurality of keys 15, and the light beams scattered downwards are further reflected upwards by assistance of the reflector 11, and thus the light beams provided by the illumination element 16 may be fully utilized. Accordingly, the plurality of keys 15 may be illuminated. However, the conventional luminous keyboard 1 has following disadvantages:

1. The light beams scattered downwards by the plurality of light guide points 121 may be reflected upwards by assistance of the reflector 11. However, the material of the reflector 11 of the conventional luminous keyboard 1 may allow the light beams to pass through. Therefore, some of the light beams scattered downwards by the plurality of light guide points 121 may pass through the reflector 11 and thus being wasted.
2. The first circuit layout 1411 is disposed at an upper surface of the lower board 141 and the first circuit layout 1411 is composed of the plurality of silver glue circuits 14211, wherein the silver glue circuits 14211 has a property of aggregating and scattering the light beams. Therefore, the silver glue circuits 14211 of the first circuit layout 1411 may be converted into a luminous status after the light beams provided by the illumination element 16 emitting into the lower board 141 via the plurality of apertures 131 of the metal base plate 13. However, most of the silver glue circuits 14211 are not correspondingly disposed with the plurality of keys 15. Therefore, the light beams initially provided for illuminating the plurality of keys 15 may be wasted due to the property of the silver glue circuits 14211, and thus the brightness of the plurality of keys 15 may not be enough.

Accordingly, it is necessary to improve the light utilization efficiency for the conventional luminous keyboard 1.

SUMMARY OF THE INVENTION

The present invention is directed to a luminous keyboard, and more particularly to a luminous keyboard for increasing light utilization efficiency (LUE).

In a preferred embodiment, the present invention provides a luminous keyboard, comprising:

- at least an illumination element for providing light beams for the luminous keyboard;
- a membrane circuit board, comprising:
  - a lower board having a first circuit layout and a plurality of light guide points, the first circuit layout having a plurality of lower pads, and the light guide points being used to aggregate and scatter the light beams provided by the illumination element, wherein the lower board comprises a first membrane and a second membrane in order to increase an upward-scattering light quality of the light guide points; and an upper board having a second circuit layout, the second circuit layout having a plurality of upper pads corresponding to the lower pads, a distance formed between each of the upper pads and the corresponding one of the lower pads, and each of the upper pads and the corresponding one of the lower pads together forming a membrane switch; and a plurality of keys corresponding to the membrane switches for conducting the membrane switches.

In a preferred embodiment, both of the first membrane and the second membrane are light guide membranes.

In a preferred embodiment, the light guide points are disposed between the first membrane and the second membrane.

In a preferred embodiment, the light guide points are disposed at one of the first membrane and the second membrane by a screen printing process, a hot pressing process or an injection process.

In a preferred embodiment, the lower board further comprises a spacing membrane disposed between the second membrane and the first circuit layout in order to increase a total reflection rate occurred in the second membrane after the light beams is received by the second membrane.

In a preferred embodiment, the spacing membrane is formed on the second membrane by a printing process, a coating process, a bonding process or a hot pressing process.

In a preferred embodiment, a transparent adhesive allowing the light beams to pass through is disposed between the first membrane and the second membrane for bonding the first membrane and the second membrane together.

In a preferred embodiment, the light guide membrane is made of PET, PC or polymethylmethacrylate (PMMA).

In a preferred embodiment, one of the first membrane and the second membrane is a spacing membrane and the other one is a light guide membrane, the spacing membrane is disposed between the light guide membrane and the first circuit layout in order to increase a total reflection rate occurred in the first membrane after the light beams is received by the first membrane.

In a preferred embodiment, the light guide points are disposed at a lower surface of the light guide membrane.

In a preferred embodiment, the spacing membrane is formed on the light guide membrane by a printing process, a coating process, a bonding process or a hot pressing process.

In a preferred embodiment, the illumination element is a LED disposed at a side of the membrane circuit board and illuminating towards the membrane circuit board.

In a preferred embodiment, the luminous keyboard further comprises a base disposed under the membrane circuit board for carrying the keys, the membrane circuit board and the illumination element.

In a preferred embodiment, each of the keys has a cap and an elastomer, the elastomer is disposed between the cap and the membrane circuit board, the elastomer is compressed to push the corresponding one of the membrane switches when the cap is pressed, and the elastomer provides an elastic force to the cap for returning the position of the cap when the cap is released.

In a preferred embodiment, the membrane circuit board further comprises a middle board disposed between the lower board and the upper board, so as to form the distance between each of the upper pads and the corresponding one of the lower pads, and the middle board has a plurality of openings corresponding to the lower pads and the upper pads.

In a preferred embodiment, the present invention further provides a luminous keyboard, comprising:

at least an illumination element for providing light beams for the luminous keyboard;

a membrane circuit board having a circuit layout and a plurality of light guide points, the circuit layout having a plurality of membrane switches, and the light guide points being used to aggregate and scatter the light beams provided by the illumination element, wherein the membrane circuit board comprises a first membrane and a second membrane in order to increase an upward-scattering light quality of the light guide points; and a plurality of keys corresponding to the membrane switches for conducting the membrane switches.

In a preferred embodiment, each of the membrane switches comprises a first conductive portion and a second conductive portion, and the first conductive portion is separated from the second conductive portion.

In a preferred embodiment, each of the keys has a cap and a conductor, the conductor is disposed between the cap and the membrane circuit board, and the conductor contacts and thus switches on the corresponding one of the membrane switches when the cap is pressed.

In a preferred embodiment, both of the first membrane and the second membrane are light guide membranes.

In a preferred embodiment, the light guide points are disposed between the first membrane and the second membrane.

In a preferred embodiment, the light guide points are disposed at one of the first membrane and the second membrane by a screen printing process, a hot pressing process or an injection process.

In a preferred embodiment, the membrane circuit board further comprises a spacing membrane disposed between the second membrane and the circuit layout in order to increase a total reflection rate occurred in the second membrane after the light beams is received by the second membrane.

In a preferred embodiment, the spacing membrane is formed on the second membrane by a printing process, a coating process, a bonding process or a hot pressing process.

In a preferred embodiment, a transparent adhesive allowing the light beams to pass through is disposed between the first membrane and the second membrane for bonding the first membrane and the second membrane together.

In a preferred embodiment, the light guide membrane is made of PET, PC or PMMA.

In a preferred embodiment, one of the first membrane and the second membrane is a spacing membrane and the other one is a light guide membrane, the spacing membrane is disposed between the light guide membrane and the circuit layout in order to increase a total reflection rate occurred in the first membrane after the light beams is received by the first membrane.

In a preferred embodiment, the light guide points are disposed at a lower surface of the light guide membrane.

In a preferred embodiment, the spacing membrane is formed on the light guide membrane by a printing process, a coating process, a bonding process or a hot pressing process.

In a preferred embodiment, the illumination element is a LED disposed at a side of the membrane circuit board and illuminating towards the membrane circuit board.

In a preferred embodiment, the luminous keyboard further comprises a base disposed under the membrane circuit board for carrying the keys, the membrane circuit board and the illumination element.

DETAILED DESCRIPTION OF THE PREFERRED EMBODIMENT

Reference will now be made in detail to specific embodiments of the present invention. Examples of these embodiments are illustrated in the accompanying drawings. While the invention will be described in conjunction with these specific embodiments, it will be understood that it is not intended to limit the invention to these embodiments. In fact, it is intended to cover alternatives, modifications, and equivalents as may be included within the spirit and scope of the invention as defined by the appended claims. In the following description, numerous specific details are set forth in order to provide a through understanding of the present invention. The present invention may be practiced without some or all of these specific details. In other instances, well-known process operations are not described in detail in order not to obscure the present invention.

Figure 1:
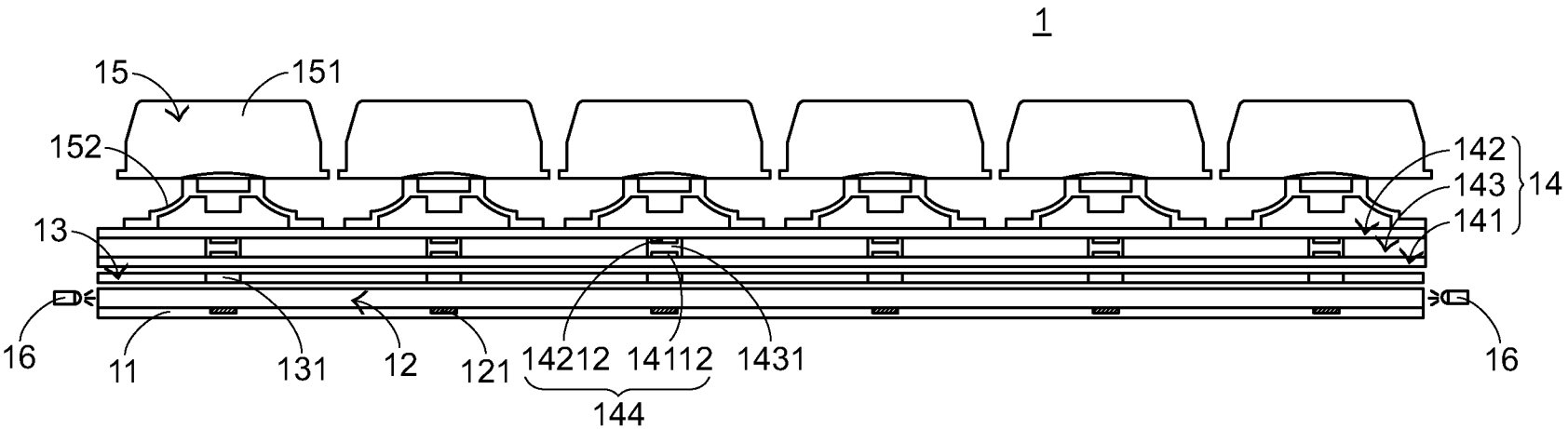
FIG. 1 (Prior Art)
FIG. 1 illustrates a structural cross-sectional view of a conventional luminous keyboard.
Figure 2:
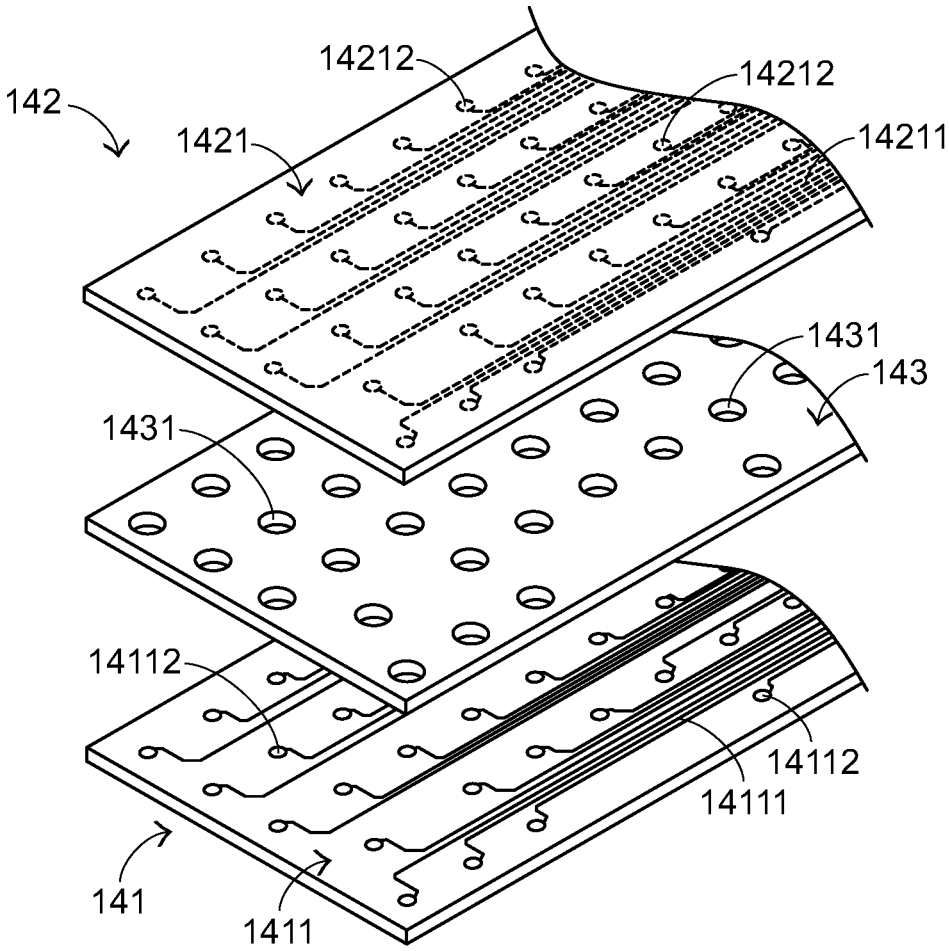
FIG. 2 (Prior Art)
FIG. 2 illustrates an exploded perspective view of a membrane circuit board of the luminous keyboard as shown in FIG. 1.
Figure 3:
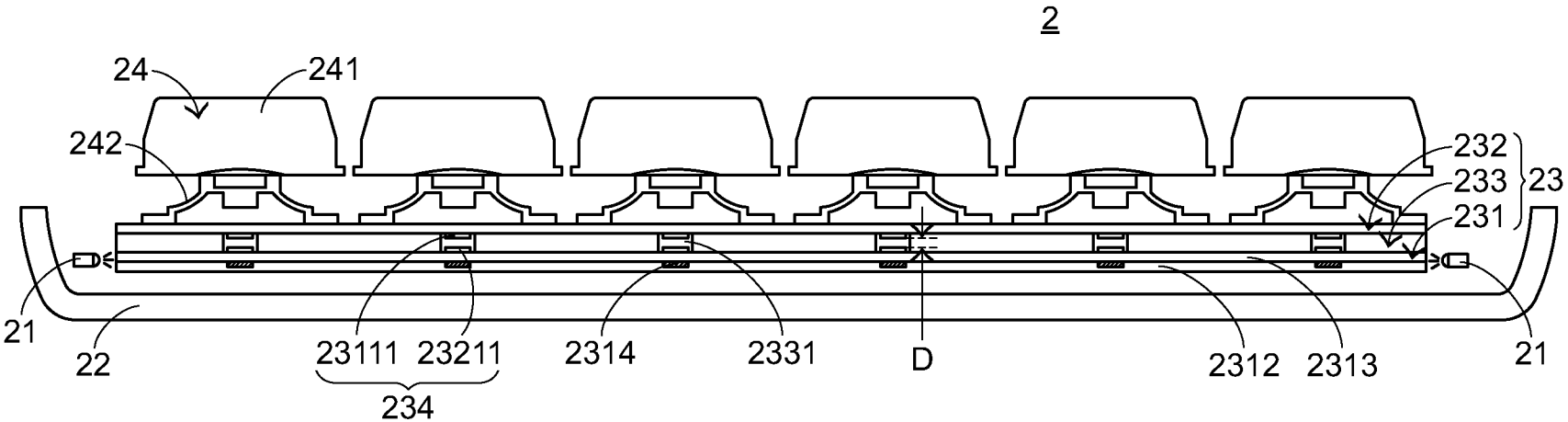
FIG. 3 illustrates a structural side view of a luminous keyboard according to a first preferred embodiment of the present invention.

FIG. 3 illustrates a structural side view of a luminous keyboard according to a first preferred embodiment of the present invention. Referring to FIG. 3, a luminous keyboard 2 comprises a base 22, a membrane circuit board 23 and a plurality of keys 24 in sequence from bottom to top. The luminous keyboard 2 further comprises an illumination element 21 disposed at a side of the membrane circuit board 23 and emitting towards the membrane circuit board 23. In the present embodiment, the illumination element 21 is a light emitting diode (LED). In addition, the base 22 is used for carrying the membrane circuit board 23 and the plurality of keys 24.

Figure 4:
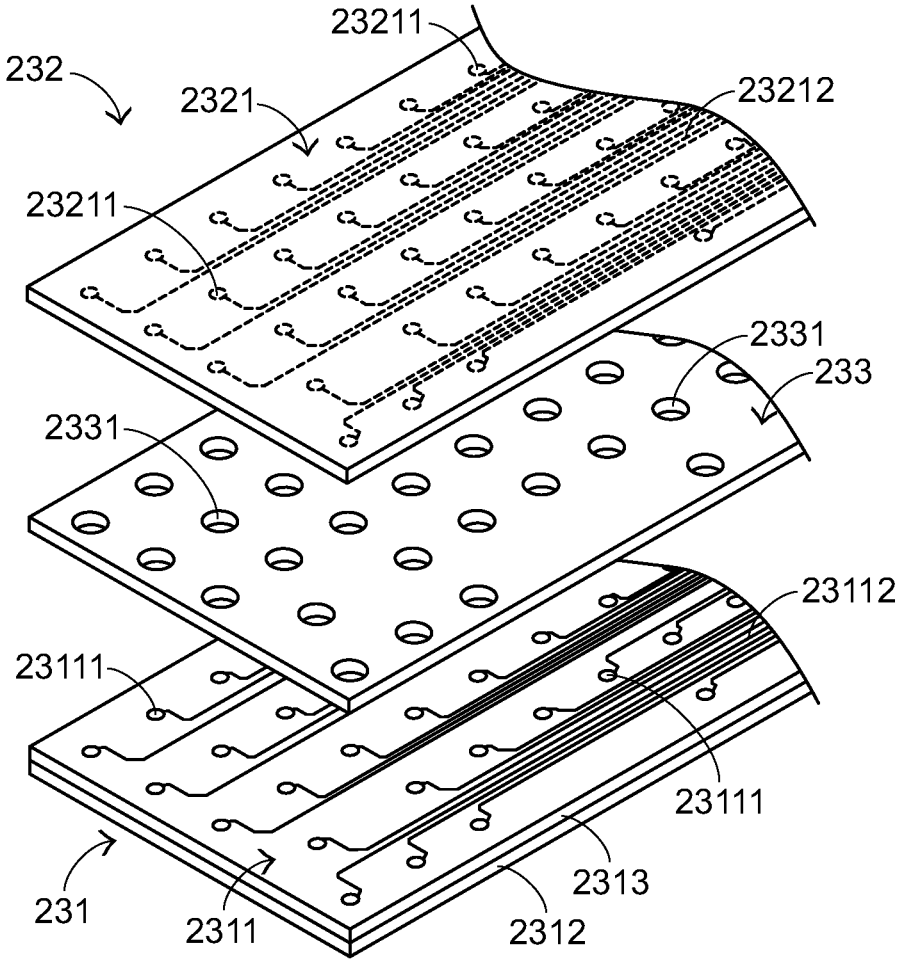
FIG. 4 illustrates an exploded perspective view of a membrane circuit board of the luminous keyboard as shown in FIG. 3.

FIG. 4 illustrates an exploded perspective view of a membrane circuit board of the luminous keyboard as shown in FIG. 3. Further referring to FIGS. 3 and 4 together, the membrane circuit board 23 comprises a lower board 231 and an upper board 232. An upper surface of the lower board 231 has a first circuit layout 2311, and the first circuit layout 2311 has a plurality of lower pads 23111. A lower surface of the upper board 232 has a second circuit layout 2321, and the second circuit layout 2321 has a plurality of upper pads 23211 corresponding to the plurality of lower pads 23111. Herein, a distance D is formed between each of the upper pads 23211 and the corresponding one of the lower pads 23111, and each of the upper pads 23211 and the corresponding one of the lower pads 23111 together form a membrane switch 234. For forming the distance D between each of the upper pads 23211 and the corresponding one of the lower pads 23111, the membrane circuit board 23 in the present embodiment further comprises a middle board 233 disposed between the lower board 231 and the upper board 232. Herein, the middle board 233 has a plurality of openings 2331 corresponding to the plurality of lower pads 23111 and the plurality of upper pads 23211

Referring to FIG. 3 again, the plurality of keys 24 are correspondingly disposed with the plurality of membrane switches 234, and each one of the plurality of keys 24 has a cap 241 and an elastomer 242. The elastomer 242 is disposed between the cap 241 and the membrane circuit board 23. When any one of the keys 24 is pressed to move downwards, the cap 241 compresses the elastomer 242 to let the elastomer 242 push the corresponding one of the upper pads 23211, and then let the corresponding one of the upper pads 23211 contact the corresponding one of the lower pads 23111 via the corresponding one of the openings 2331. Hence, the corresponding one of the membrane switches 234 is switched on, and then the luminous keyboard 2 generates a corresponding key signal accordingly. In addition, when the cap 241 is released, the position of the cap 241 returns upwards due to an elastic force of the elastomer 242.

Figure 5:
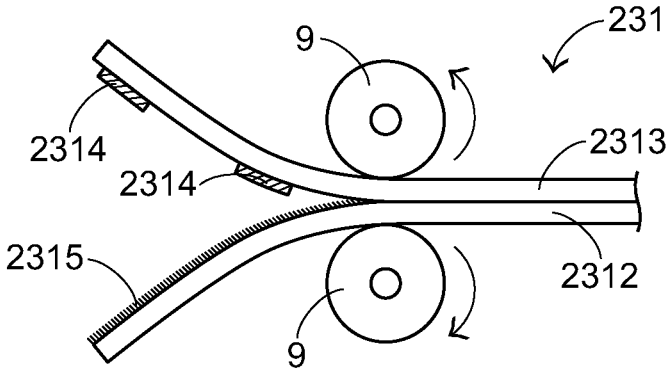
FIG. 5 illustrates a structural side view and a process diagram of a lower board of the membrane circuit board of the luminous keyboard according to the first preferred embodiment of the present invention.

One characteristic of the present invention is multi-layer membrane design of the lower board 231 of the membrane circuit board 23 of the luminous keyboard 2. FIG. 5 illustrates a structural side view and a process diagram of a lower board of the membrane circuit board of the luminous keyboard according to the first preferred embodiment of the present invention. Referring to FIG. 5, in the first preferred embodiment, the lower board 231 comprises a first membrane 2312 and a second membrane 2313 attached on an upper surface of the first membrane 2312. A plurality of light guide points 2314 used for aggregating and scattering the light beams provided by the illumination element 21 are disposed between the first membrane 2312 and the second membrane 2313, and the plurality of light guide points 2314 are disposed according to the positions of the keys 24, and thus the plurality of light guide points 2314 may project the light beams upwards to regions of the plurality of keys 24. In addition, each of the first membrane 2312 and the second membrane 2313 is a light guide membranes, and a material thereof may be PC or PET. Further, the first circuit layout 2311 is printed on the upper surface of the second membrane 2313.

A manufacturing method of the lower broad 231 is illustrated as below. First, the plurality of light guide points 2314 are disposed on the upper surface of the first membrane 2312, and a transparent glue 2315 allowing the light beams to pass through is disposed on the lower surface of the second membrane 2313. Next, a hot pressing process or a cold pressing process is processed by using a roller 9 to bond the first membrane 2312 and the second membrane 2313 together. Alternatively, the plurality of light guide points 2314 may be disposed on the lower surface of the second membrane 2313, and the transparent glue 2315 allowing the light beams to pass through may be disposed on the upper surface of the first membrane 2312

Figure 6:
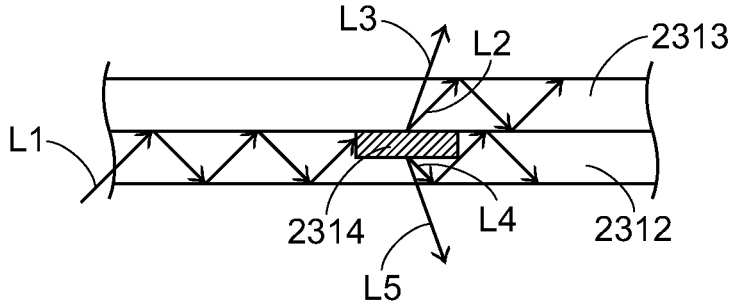
FIG. 6 illustrates an optical path diagram of the lower board as shown in FIG. 5.

FIG. 6 illustrates an optical path diagram of the lower board as shown in FIG. 5. Referring to FIG. 6, after the light beams provided by the illumination element 21 are emitted into the lower board 231, the light beams L1 are diffused in the first membrane 2312 and the second membrane 2314. When the light beams are transmitted to the light guide points 2314, the light guide points 2314 aggregate a part of the light beams and scatter the other part of the light beams upwards or downwards. Herein, the part of the light beams L2 scattered upwards are transmitted in the second membrane 2313, and the other part of the light beams L3 pass through the second membrane 2313 and are projected upwards to the regions of the keys 24, so as to illuminate the keys 24. In addition, the part of the light beams L4 scattered downwards are transmitted in the first membrane 2312, and the other part of the light beams L5 pass through the first membrane 2312 and thus being wasted.

The advantage of the lower board in the first preferred embodiment is that the part of the light beams L4 scattered downwards by the light guide points 2314 (the light beams L4 continuously transmitted in the first membrane 2312) may be reused by the first membrane 2312 due to the plurality of light guide points 2314 are disposed between the first membrane 2312 and the second membrane 2313. Therefore, only the part of the light beams L5 (the light beams L5 pass through the first membrane 2312) are wasted. In another word, if the lower board 231 only has the second membrane 2313 and the plurality of light guide points 2314 without the first membrane 2312, all of the light beams scattered downwards by the light guide points 2314 will be wasted.

Figure 7:
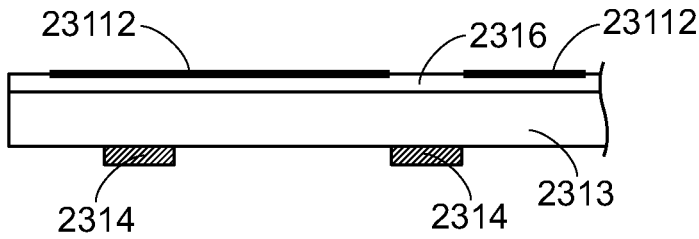
FIG. 7 illustrates a structural side view of a lower board of a membrane circuit board of a luminous keyboard according to a second preferred embodiment of the present invention.
Figure 8:
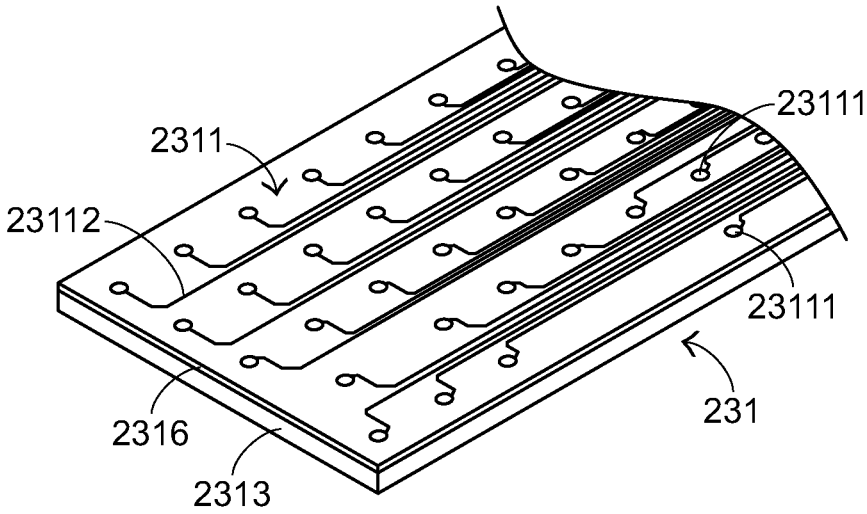
FIG. 8 illustrates a structural side view of the lower board as shown in FIG. 7 from another view angle.

Next, a second preferred embodiment is illustrated as below, which is substantially similar to the first preferred embodiment, besides the composition of the lower board of the membrane circuit board. However, the lower board herein is multi-layer membrane design as well. Referring to FIGS. 7 and 8, wherein FIG. 7 illustrates a structural side view of a lower board of a membrane circuit board of a luminous keyboard according to a second preferred embodiment of the present invention, and FIG. 8 illustrates a structural side view of the lower board as shown in FIG. 7 from another view angle.

In the second preferred embodiment, the lower board 231 comprises the second membrane 2313 and a spacing membrane 2316 disposed on the upper surface of the second membrane 2313. Herein, the plurality of light guide points 2314 are disposed on the lower surface of the second membrane 2313 and according to the locations of the plurality of keys 24. Therefore, the light beams may be projected upwards to the regions of the plurality of keys 24 by the plurality of light guide points 2314. In addition, the first circuit layout 2311 is printed on the upper surface of the spacing membrane 2316, and the first circuit layout 2311 is composed of the plurality of lower pads 23111 and the plurality of silver glue circuits 23112. Further, the silver glue circuits 23112 have the property of aggregating and scattering the light beams. Moreover, in the process of manufacturing the lower board 231, the spacing membrane 2316 is formed on the upper surface of the second membrane 2313 by a printing process, a coating process, a bonding process or a hot pressing process. Furthermore, the second membrane 2313 is a light guide membrane, and a material thereof may be PC, PET or PMMA, wherein the material of the spacing membrane 2316 is different from that of the second membrane 2313.

Figure 9:
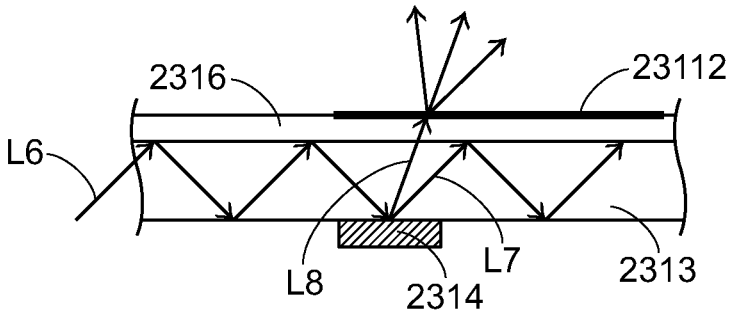
FIG. 9 illustrates an optical path diagram of the lower board as shown in FIG. 7.

FIG. 9 illustrates an optical path diagram of the lower board as shown in FIG. 7. Referring to FIG. 9, after the light beams provided by the illumination element 21 emitted into the lower board 231, the light beams L6 are diffused in the second membrane 2313. In addition, when the light beams L6 are transmitted to the light guide points 2314, the light guide points 2314 aggregate a part of the light beams and scatter the other part of the light beams upwards. Herein, the part of the light beams L7 scattered upwards are transmitted in the second membrane 2313, and the other part of the light beams L8 pass through the second membrane 2313. In the second preferred embodiment, because the spacing membrane 2316 is disposed between the first circuit layout 2311 and the second membrane 2313 and the material thereof is different from the second membrane 2313, the light beams are likely to be totally reflected in the second membrane 2313 (as the routes of the light beams L6, L7), and it is possible to avoid the light beams being aggregated and scattered by the silver glue circuits 23112 of the first circuit layout 2311 after passing through the second membrane 2313 (as the routes of the light beam L8). Therefore, the amount of the light beams scattered upwards by the plurality of light guide points 2314 in the lower board 231 may be enhanced, and thus the keys 24 of the luminous keyboard 2 may receive more light beams.

Figure 10:
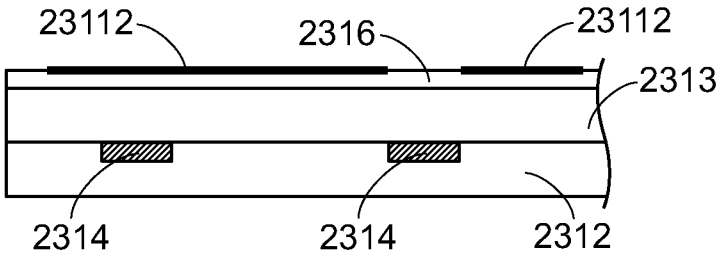
FIG. 10 illustrates a structural side view of a lower board of a membrane circuit board of a luminous keyboard according to a third preferred embodiment of the present invention.

Next, a third preferred embodiment is illustrated as below, which is substantially similar to the first and the second preferred embodiments, besides the composition of the lower board 231 of the membrane circuit board 23, wherein the composition of the lower board 231 of the third preferred embodiment is a combination design of the lower board of the first and the second preferred embodiments. Referring to FIG. 10, which illustrates a structural side view of a lower board of a membrane circuit board of a luminous keyboard according to a third preferred embodiment of the present invention.

In the third preferred embodiment, the lower board 231 comprises the first membrane 2312, the second membrane 2313 attached on the upper surface of the first membrane 2312 and the spacing membrane 2316 disposed on the upper surface of the second membrane 2313. The plurality of light guide points 2314 used for aggregating and scattering the light beams provided by the illumination element 21 are disposed between the first membrane 2312 and the second membrane 2313 and according to the locations of the plurality of keys 24. Therefore, the light beams may be projected upwards to the regions of the plurality of keys 24 by the plurality of light guide points 2314. In addition, the first circuit layout 2311 is printed on the upper surface of the spacing membrane 2316, and the first circuit layout 2311 has the plurality of silver glue circuits (un-illustrated in FIG. 10, referring to FIG. 8), wherein the silver glue circuits have the properties of aggregating and scattering the light beams. Therefore, the advantage of the lower board 231 in the third preferred embodiment is a combination of the advantages as illustrated in the first and the second preferred embodiments, besides, the materials and the processes of the lower board 231 in the third preferred embodiment are as illustrated in the first and the second preferred embodiments and omitted herein.

Figure 11:
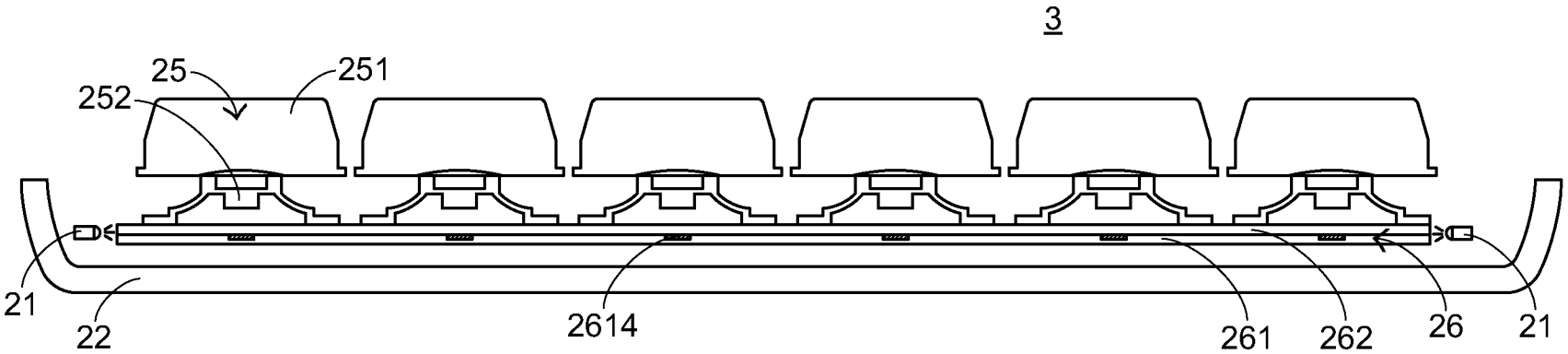
FIG. 11 illustrates a structural side view of a luminous keyboard according to a fourth preferred embodiment of the present invention.
Figure 12:
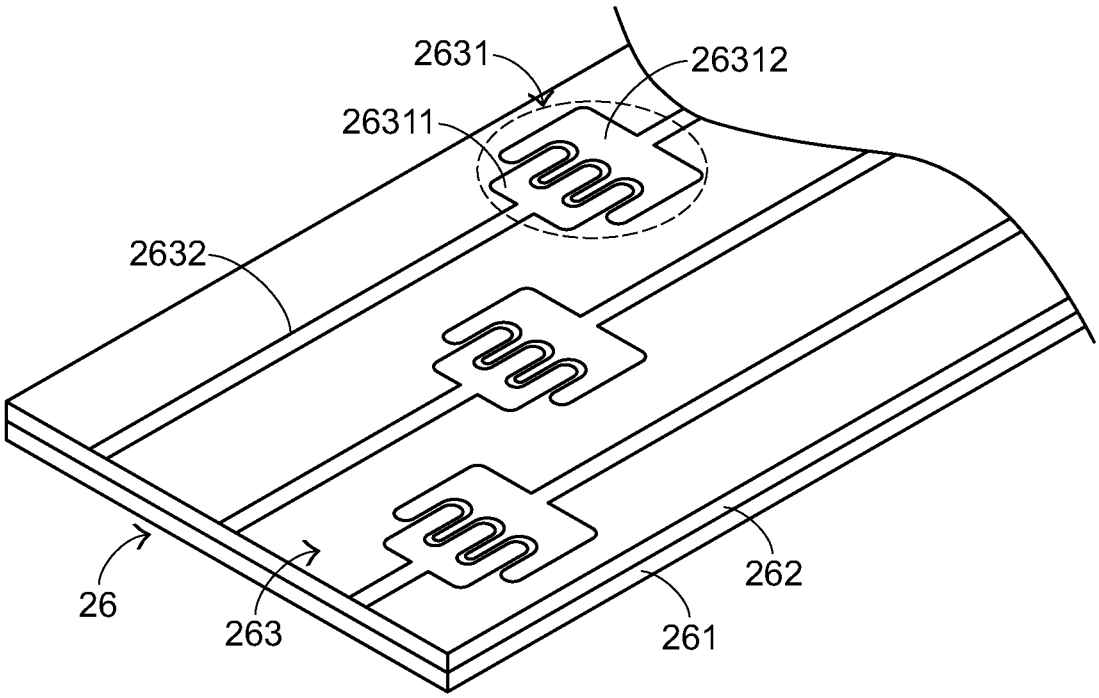
FIG. 12 illustrates a structural view of a membrane circuit board of the luminous keyboard as shown in FIG. 11.

Next, a fourth preferred embodiment is illustrated as below. Referring to FIGS. 11 and 12, wherein FIG. 11 illustrates a structural side view of a luminous keyboard 4 according to a fourth preferred embodiment of the present invention, and FIG. 12 illustrates a structural view of a membrane circuit board of the luminous keyboard as shown in FIG. 11.

The luminous keyboard 4 of the fourth preferred embodiment is substantially similar to the first preferred embodiment, besides a membrane circuit board 26 herein is a single-layer membrane. In the present embodiment, an upper surface of the membrane circuit board 26 has an circuit layout 263, and the circuit layout 263 has a plurality of membrane switches and a plurality of silver glue circuits 2632. Each of the membrane switch 2631 comprises a first conductive portion 26311 and a second conductive portion 26312, and the first conductive portion 26311 is separated from the second conductive portion. In addition, each of keys 25 herein has a cap 251 and a conductor 252, the conductor 252 is disposed between the cap 251 and the membrane circuit board 26, and the conductor 252 contacts and thus switches on the corresponding one of the membrane switches 2631 when the cap 251 is pressed. Therefore, a luminous keyboard 2 herein generates a corresponding key signal accordingly.

It should be note that the membrane circuit board 26 in the present embodiment is still a multi-layer membrane design and comprises a first membrane 261 and a second membrane 262 (as the first membrane 2312 and the second membrane 2313 illustrated in the first embodiment). Further, a plurality of light guide points 2614 used for aggregating and scattering the light beams provided by the illumination element 21 are also disposed between the first membrane 261 and the second membrane 262. Hence, the membrane circuit board 26 in the present embodiment also has the advantages of the lower board 231 as described in the first preferred embodiment.

In a fifth embodiment, the membrane circuit board 26 of the luminous keyboard 2 in the fourth preferred embodiment may be stacked as the membrane stacking method of the lower board 231 in the second preferred embodiment. In other words, the membrane circuit board 26 in the fifth embodiment comprises a second membrane 262 and a spacing membrane (un-illustrated herein) disposed on the upper surface of the second membrane 262. Further, the plurality of light guide points 2614 are disposed on the lower surface of the second membrane 262. Therefore, the membrane circuit board 26 has the advantages of the lower board 231 as described in the second preferred embodiment.

In a sixth embodiment, the membrane circuit board 26 of the luminous keyboard 2 in the fourth preferred embodiment may be stacked as the membrane stacking method of the lower board 231 in the third preferred embodiment. In other words, the membrane circuit board 26 in the sixth embodiment comprises the first membrane 261, the second membrane 262 attached on the upper surface of the first membrane 261 and the spacing membrane (un-illustrated herein) disposed on the upper surface of the second membrane 262. Further, the plurality of light guide points 2614 used for aggregating and scattering the light beams provided by the illumination element 21 are disposed between the first membrane 261 and the second membrane 262. Therefore, the membrane circuit board 26 has the advantages of the lower board 231 as described in the third preferred embodiment.

According to each of the above-mentioned preferred embodiments, it is obvious that the manufacturing cost of the luminous keyboard 2 in the present invention may be reduced due to without using an additional light guide plate. In addition, the membrane circuit board 23 or the lower board 231 in the luminous keyboard 2 designed as multi-layer membrane may not only avoid wasting the light beams utilized to the keys 24, 25 due to the silver glue circuits 2632 of the circuit layout 263 or the silver glue circuits 23112 of the circuit layout 2311 having the property of aggregating the light beams, but also reuse the wasted light beams scattered downwards by the plurality of light guide points 2614, 2314, so as to enhance the light beams scattered upwards by the plurality of light guide points 2614, 2314. Therefore, the keys 24, 25 of the luminous keyboard 2 may receive more light beams, and thus the luminous keyboard 2 of the present invention may use the light beams provided by the illumination element 21 most effectively.

Although specific embodiments of the present invention have been described, it will be understood by those of skill in the art that there are other embodiments that are equivalent to the described embodiments. Accordingly, it is to be understood that the invention is not to be limited by the specific illustrated embodiments, but only by the scope of the appended claims.

What is claimed is:

1. A luminous keyboard, comprising:

at least an illumination element for providing light beams for the luminous keyboard;

a membrane circuit board, comprising:

a lower board having a first circuit layout and a plurality of light guide points, the first circuit layout having a plurality of lower pads, and the light guide points being used to aggregate and scatter the light beams provided by the illumination element, wherein the lower board comprises a first membrane and a second membrane in order to increase an upward-scattering light quality of the light guide points; and an upper board having a second circuit layout, the second circuit layout having a plurality of upper pads corresponding to the lower pads, a distance formed between each of the upper pads and the corresponding one of the lower pads, and each of the upper pads and the corresponding one of the lower pads together forming a membrane switch; and a plurality of keys corresponding to the membrane switches for conducting the membrane switches.

2. The luminous keyboard as claimed in claim 1, wherein both of the first membrane and the second membrane are light guide membranes.

3. The luminous keyboard as claimed in claim 2, wherein the light guide points are disposed between the first membrane and the second membrane.

4. The luminous keyboard as claimed in claim 3, wherein the light guide points are disposed at one of the first membrane and the second membrane by a screen printing process, a hot pressing process or an injection process.

5. The luminous keyboard as claimed in claim 3, wherein the lower board further comprises a spacing membrane disposed between the second membrane and the first circuit layout in order to increase a total reflection rate occurred in the second membrane after the light beams is received by the second membrane.

6. The luminous keyboard as claimed in claim 5, wherein the spacing membrane is formed on the second membrane by a printing process, a coating process, a bonding process or a hot pressing process.

7. The luminous keyboard as claimed in claim 2, wherein a transparent adhesive allowing the light beams to pass through is disposed between the first membrane and the second membrane for bonding the first membrane and the second membrane together.

8. The luminous keyboard as claimed in claim 2, wherein the light guide membrane is made of PET, PC or PMMA.

9. The luminous keyboard as claimed in claim 1, wherein one of the first membrane and the second membrane is a spacing membrane and the other one is a light guide membrane, the spacing membrane is disposed between the light guide membrane and the first circuit layout in order to increase a total reflection rate occurred in the first membrane after the light beams is received by the first membrane.

10. The luminous keyboard as claimed in claim 9, wherein the light guide points are disposed at a lower surface of the light guide membrane.

11. The luminous keyboard as claimed in claim 9, wherein the spacing membrane is formed on the light guide membrane by a printing process, a coating process, a bonding process or a hot pressing process.

12. The luminous keyboard as claimed in claim 1, wherein the illumination element is a LED disposed at a side of the membrane circuit board and illuminating towards the membrane circuit board.

13. The luminous keyboard as claimed in claim 1, further comprising a base disposed under the membrane circuit board for carrying the keys, the membrane circuit board and the illumination element.

14. The luminous keyboard as claimed in claim 1, wherein each of the keys has a cap and an elastomer, the elastomer is disposed between the cap and the membrane circuit board, the elastomer is compressed to push the corresponding one of the membrane switches when the cap is pressed, and the elastomer provides an elastic force to the cap for returning the position of the cap when the cap is released.

15. The luminous keyboard as claimed in claim 1, wherein the membrane circuit board further comprises a middle board disposed between the lower board and the upper board, so as to form the distance between each of the upper pads and the corresponding one of the lower pads, and the middle board has a plurality of openings corresponding to the lower pads and the upper pads.

16. A luminous keyboard, comprising:

at least an illumination element for providing light beams for the luminous keyboard;

a membrane circuit board having a circuit layout and a plurality of light guide points, the circuit layout having a plurality of membrane switches, and the light guide points being used to aggregate and scatter the light beams provided by the illumination element, wherein the membrane circuit board comprises a first membrane and a second membrane in order to increase an upward-scattering light quality of the light guide points; and a plurality of keys corresponding to the membrane switches for conducting the membrane switches.

17. The luminous keyboard as claimed in claim 16, wherein each of the membrane switches comprises a first conductive portion and a second conductive portion, and the first conductive portion is separated from the second conductive portion.

18. The luminous keyboard as claimed in claim 17, wherein each of the keys has a cap and a conductor, the conductor is disposed between the cap and the membrane circuit board, and the conductor contacts and thus switches on the corresponding one of the membrane switches when the cap is pressed.

19. The luminous keyboard as claimed in claim 16, wherein both of the first membrane and the second membrane are light guide membranes.

20. The luminous keyboard as claimed in claim 19, wherein the light guide points are disposed between the first membrane and the second membrane.

21. The luminous keyboard as claimed in claim 20, wherein the light guide points are disposed at one of the first membrane and the second membrane by a screen printing process, a hot pressing process or an injection process.

22. The luminous keyboard as claimed in claim 20, wherein the membrane circuit board further comprises a spacing membrane disposed between the second membrane and the circuit layout in order to increase a total reflection rate occurred in the second membrane after the light beams is received by the second membrane.

23. The luminous keyboard as claimed in claim 22, wherein the spacing membrane is formed on the second membrane by a printing process, a coating process, a bonding process or a hot pressing process.

24. The luminous keyboard as claimed in claim 19, wherein a transparent adhesive allowing the light beams to pass through is disposed between the first membrane and the second membrane for bonding the first membrane and the second membrane together.

25. The luminous keyboard as claimed in claim 19, wherein the light guide membrane is made of PET, PC or PMMA.

26. The luminous keyboard as claimed in claim 16, wherein one of the first membrane and the second membrane is a spacing membrane and the other one is a light guide membrane, the spacing membrane is disposed between the light guide membrane and the circuit layout in order to increase a total reflection rate occurred in the first membrane after the light beams is received by the first membrane.

27. The luminous keyboard as claimed in claim 26, wherein the light guide points are disposed at a lower surface of the light guide membrane.

28. The luminous keyboard as claimed in claim 26, wherein the spacing membrane is formed on the light guide membrane by a printing process, a coating process, a bonding process or a hot pressing process.

29. The luminous keyboard as claimed in claim 16, wherein the illumination element is a LED disposed at a side of the membrane circuit board and illuminating towards the membrane circuit board.

30. The luminous keyboard as claimed in claim 16, further comprising a base disposed under the membrane circuit board for carrying the keys, the membrane circuit board and the illumination element.

* * * * *